US005786579A

United States Patent [19]

Park

[11] Patent Number: 5,786,579

[45] Date of Patent: Jul. 28, 1998

[54] MICROWAVE OVEN WAVEGUIDE WITH MODE TRANSDUCER AND DIFFERENTIAL MODE ABSORBER

[75] Inventor: Hyung-Ki Park, Incheon, Rep. of Korea

[73] Assignee: Daewoo Electronics Co., Ltd., Seoul, Rep. of Korea

[21] Appl. No.: 807,147

[22] Filed: Feb. 27, 1997

[30] Foreign Application Priority Data

Dec. 27, 1996 [KR] Rep. of Korea ..... 96-74025

[51] Int. Cl.[6] ..... H05B 6/74

[52] U.S. Cl. ..... 219/746; 219/750; 219/751

[58] Field of Search ..... 219/746, 747, 219/748, 749, 750, 751

[56] References Cited

U.S. PATENT DOCUMENTS

| | | | |
|---|---|---|---|
| 3,127,494 | 3/1964 | Kellough et al. | 219/746 |
| 3,764,770 | 10/1973 | Saad et al. | 219/746 |
| 4,185,181 | 1/1980 | Kaneko et al. | 219/748 |
| 4,496,814 | 1/1985 | Fitzmayer | 219/746 |
| 4,839,494 | 6/1989 | Vulpe | 219/746 |
| 4,937,418 | 6/1990 | Boulard | 219/751 |

FOREIGN PATENT DOCUMENTS 1 362 076 7/1974 United Kingdom .

*Primary Examiner*—Philip H. Leung

*Attorney, Agent, or Firm*—Cushman Darby & Cushman IP Group of Pillsbury Madison & Sutro LLP

[57] ABSTRACT

Disclosed is a wave guide used in a microwave oven, by which superimposed high-frequency microwaves are radiated towards food to be heated, and distorted waves included in the high-frequency microwaves are removed. The wave guide has a housing provided with a magnetron, a mode transducer disposed in the housing so as to superimpose and distribute a high-frequency microwave radiated from the magnetron, and a differential mode absorber for absorbing a distorted wave included in the high-frequency microwave which has been passed through the mode transducer. The mode transducer includes a first hollow-frustuconical member welded to an inner wall of the housing, a second hollow-frustuconical member accommodated in the first hollow-frustuconical member, and a transmission line attached to an inner wall of the second hollow-frustuconical member. Upper and lower support strips for supporting the second hollow-frustuconical member are provided between an inner wall of the first hollow-frustuconical member and an outer wall of the second hollow-frustuconical member. By the wave guide, the heating efficiency is improved and cooking time is shortened. The wave guide ensures the uniform heating of the food.

10 Claims, 4 Drawing Sheets

MICROWAVE OVEN WAVEGUIDE WITH MODE TRANSDUCER AND DIFFERENTIAL MODE ABSORBER

BACKGROUND OF THE INVENTION

1. Field of the Invention

The present invention relates to a microwave oven, and more particularly to a wave guide used in a microwave oven, by which not only can superimposed high-frequency microwaves be radiated towards food to be heated, but also distorted waves included in the high-frequency microwaves can be removed, thereby effectively heating the food.

2. Prior Arts

As is well known, a microwave oven is an appliance for heating food by passing microwaves through the food. Generally, the microwave oven has a magnetron which generates microwaves when a high-voltage is applied thereto. In the microwave oven, the magnetron generates approximately 2,450 MHz microwaves. When the high-frequency microwaves are applied to the food contained in a heating chamber, particles of the food are rapidly moved so that a frictional heat is generated due to a friction between the particles. The microwave oven heats the food by using the frictional heat.

Such microwaves are generated when a high-voltage produced by primary and secondary induction coils of a transformer disposed at a bottom wall of a cabinet is supplied to the magnetron, and such microwaves are radiated into a heating chamber through a wave guide.

FIG. 6 shows such a conventional microwave oven 400.

As shown in FIG. 6, conventional microwave oven 400 has a cabinet 430.

Cabinet 430 includes a heating chamber 410 and a control chamber 420 which are separated from each other by a partition 415.

A wave guide 450, which guides high-frequency microwaves generated from a magnetron 440 into heating chamber 410, is attached to a predetermined position on partition 415. Magnetron 440 is coupled to a side wall of wave guide 450. In order to radiate the high-frequency microwaves into heating chamber 410, an opening 452 is formed at a predetermined position in heating chamber 410. In addition, an antenna 442 for sending the high-frequency microwaves is integrally formed with magnetron 440.

A transformer 460 for generating a high-voltage is mounted on a bottom wall of control chamber 420. Transformer 460 is connected to magnetron 440 so as to apply the high-voltage to magnetron 440.

A cooking tray 480, on which food to be heated is placed, is provided in heating chamber 410. In order to uniformly heat the food, cooking tray 480 is connected to a motor 470 by a shaft 472 and is rotated while the food is being heated.

Microwave oven 400 having the above structure operates as follows.

Firstly, when a user turns on an operating switch(not shown) attached to a front portion of cabinet 430, a microcomputer(not shown) accommodated in microwave oven 400 sends an operating signal to transformer 460. As a result, transformer 460 generates the high-voltage and transfers the high-voltage to magnetron 440 so that the high-frequency microwaves are generated by magnetron 440. The high-frequency microwaves are transferred to heating chamber 410 by way of antenna 442, wave guide 450, and opening 452, so the food placed on cooking tray 480 is heated.

At the same time, the microcomputer sends an operating signal to motor 470, so that cooking tray 480 rotates while the food is being heated.

However, microwave oven 400 having the above structure has a disadvantage in that the microwaves penetrate into the food to be heated only to a limited depth. For this reason, when a large quantity of the food is placed on cooking tray 480, the microwaves do not reach a portion of the food, so the food is not uniformly heated.

In order to solve the above problem, another conventional microwave oven including a means for stirring the substance contained in a receptacle, thereby causing all of the substance to be subjected to the microwaves, has been proposed.

However, the above conventional microwave oven requires a sufficient stirring of the substance in order to obtain the uniform temperature of the substance. Moreover, such stirring is difficult when the substance to be heated is fragile.

On the other hand, U.S. Pat. No. 4,937,418 issued to Boulard discloses a microwave oven fitted with a wave spreader which makes it possible to make the temperature distribution inside the receptacle more uniform while minimizing the stirring of the substance.

Boulard's microwave oven comprises a wave spreader including a wave guide. The wave guide has at least one wave-receiving opening formed at an upper portion thereof and at least one wave-diffusing opening formed at a lower portion thereof. First and second deflectors for deflecting microwaves are provided in the wave guide.

However, Boulard's wave spreader is made as a separate device and installed in a heating chamber, so the useable volume of the heating chamber is reduced.

SUMMARY OF THE INVENTION

The present invention has been made to solve the problems of the prior arts, and accordingly, it is an object of the present invention to provide a wave guide for a microwave oven, by which not only are a high-frequency microwaves uniformly radiated into a heating chamber, but also distorted waves included in the high-frequency microwaves can be removed, thereby improving the heating efficiency of food to be heated.

To accomplish the above object of the present invention, there is provided a wave guide for a microwave oven having a heating chamber and a control chamber which is separated from the heating chamber by a partition, the wave guide comprising:

- a housing disposed in the heating chamber, the housing being attached to the partition and being provided at a side wall thereof with a magnetron for generating the high-frequency microwave;
- a mode transducer for superimposing and distributing a high-frequency microwave radiated from the magnetron, the mode transducer being disposed in the housing; and
- a differential mode absorber for absorbing a distorted wave included in the high-frequency microwave which has been passed through the mode transducer, the mode transducer being disposed in the housing.

According to a preferred embodiment of the present invention, the mode transducer includes a first hollow-frustuconical member having a first wave guiding opening, a second hollow-frustuconical member having a second wave guiding opening, and a transmission line attached to an inner wall of the second hollow-frustuconical member. The first hollow-frustuconical member is welded to an inner wall of the housing and the second hollow-frustuconical member is accommodated in the first hollow-frustuconical member.

The microwave oven having the wave guide according to the present invention operates as follows.

Firstly, when a user turns on an operating switch attached to a front portion of a cabinet, a microcomputer accommodated in the microwave oven sends an operating signal to a transformer. As a result, the transformer generates the high-voltage and transfers the high-voltage to the magnetron so that the high-frequency microwaves are generated by the magnetron.

Then, the high-frequency microwaves are dispersed into the first and second wave guiding openings formed in the first and second hollow-frustuconical members, respectively.

When the high-frequency microwaves has been passed through the mode transducer, a magnetic field and an electric field of the high-frequency microwave are deflected against each other. This kind of deflection occurs due to geometrical variation of passages into which the high-frequency microwaves pass. In addition, the high-frequency microwaves are superimposed over each other.

While passing through the differential mode absorber, distorted waves included in the high-frequency microwaves are absorbed by the differential mode absorber.

Accordingly, superimposed and dispersed high-frequency microwaves are radiated into the heating chamber, so the food placed in the heating chamber is effectively heated. These kinds of high-frequency microwaves make the inside temperature of heating chamber 110 more uniform and improve the heating efficiency.

BRIEF DESCRIPTION OF THE DRAWINGS

The above object and other advantages of the present invention will become more apparent by describing in detail a preferred embodiment thereof with reference to the attached drawings, in which.

DETAILED DESCRIPTION OF THE INVENTION

Hereinafter, the present invention will be described in detail with reference to the accompanying drawings.

Figure 1:
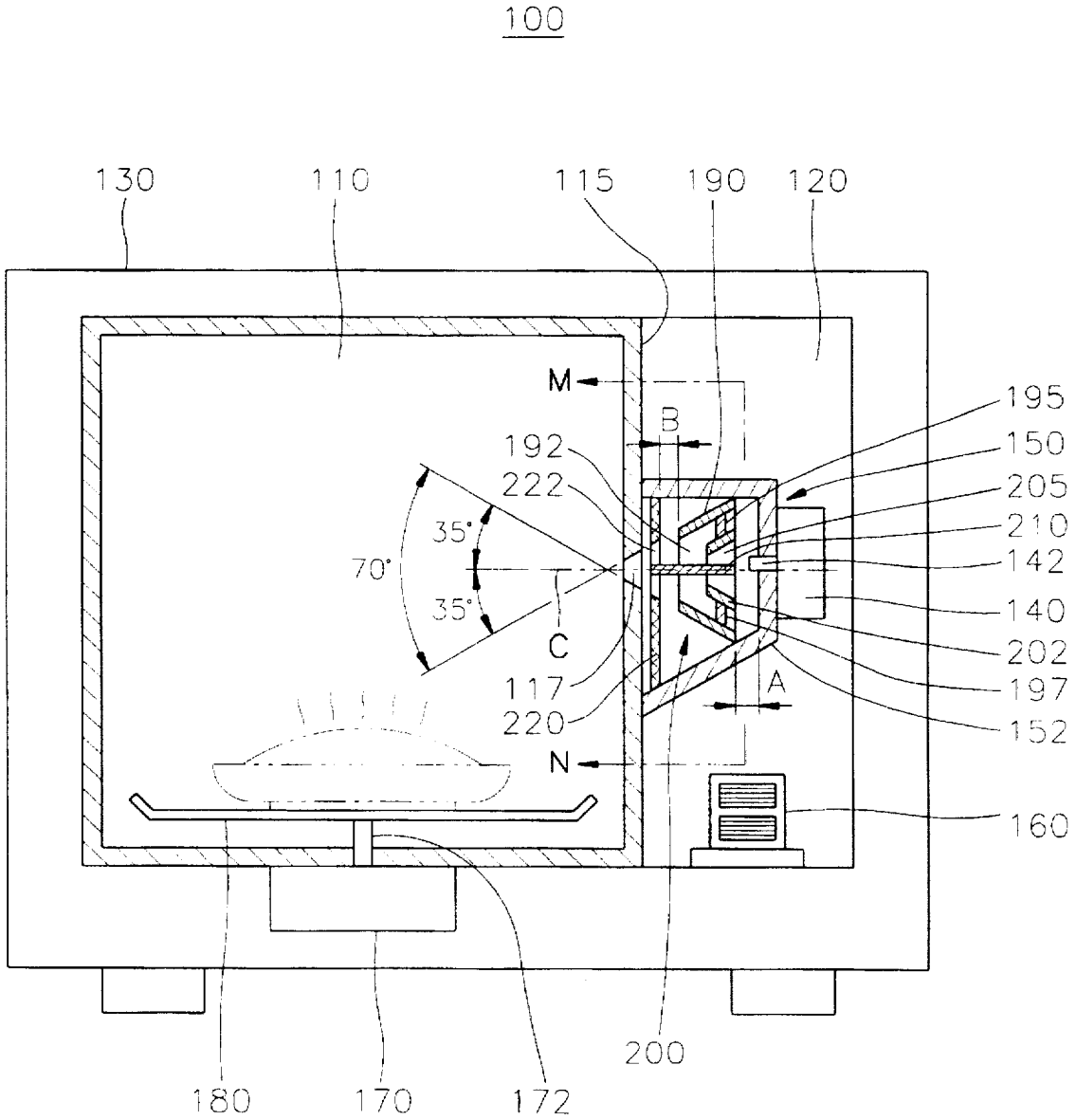
FIG. 1 is a sectional view of a microwave oven having a wave guide according to one embodiment of the present invention.

FIG. 1 shows a microwave oven 100 having a wave guide 150 according to one embodiment of the present invention.

As shown in FIG. 1, microwave oven 100 has a cabinet 130. Cabinet 130 includes a heating chamber 110 and a control chamber 120 which are separated from each other by a partition 115.

Wave guide 150, which guides high-frequency microwaves generated from a magnetron 140 into heating chamber 110, is attached to a predetermined position on partition 115. Partition 115 is formed at its predetermined position with an aperture 117 for guiding the high-frequency microwaves into heating chamber 110. Magnetron 140 is coupled to a side wall of wave guide 150. In addition, an antenna 142 for transmitting the high-frequency microwaves is integrally formed with magnetron 140.

A transformer 160 for generating a high-voltage is mounted on a bottom wall of control chamber 120. Transformer 160 is connected to magnetron 140 so as to apply the high-voltage to magnetron 140.

A cooking tray 180, on which food to be heated is placed, is provided in heating chamber 110. In order to uniformly heat the food, cooking tray 180 is connected to a motor 170 by a shaft 172 and is rotated while the food is being heated.

Wave guide 150 comprises a housing 152 which is attached to partition 115 by a fastening means such as welding. Disposed in housing 152 are a mode transducer 200, by which the high-frequency microwaves generated from magnetron 140 are superimposed and distributed, and a differential mode absorber 220 which absorbs the distorted waves included in the high-frequency microwaves.

Mode transducer 200 includes a first hollow-frustuconical member 190 having a first wave guiding opening 192, includes a second hollow-frustuconical member 202 which is accommodated in first hollow-frustuconical member 190 and has a second wave guiding opening 205, and includes a transmission line 210 which is attached to an inner wall of second hollow-frustuconical member 202 by a fastening method such as spot welding and extends to a position of differential mode absorber 220.

First and second hollow-frustuconical members 190 and 202 are coaxially disposed with each other. Preferably, each of first and second hollow-frustuconical members 190 and 202 is inclined at an angle of about 35 degrees with respect to a central axis C thereof.

Figure 2:
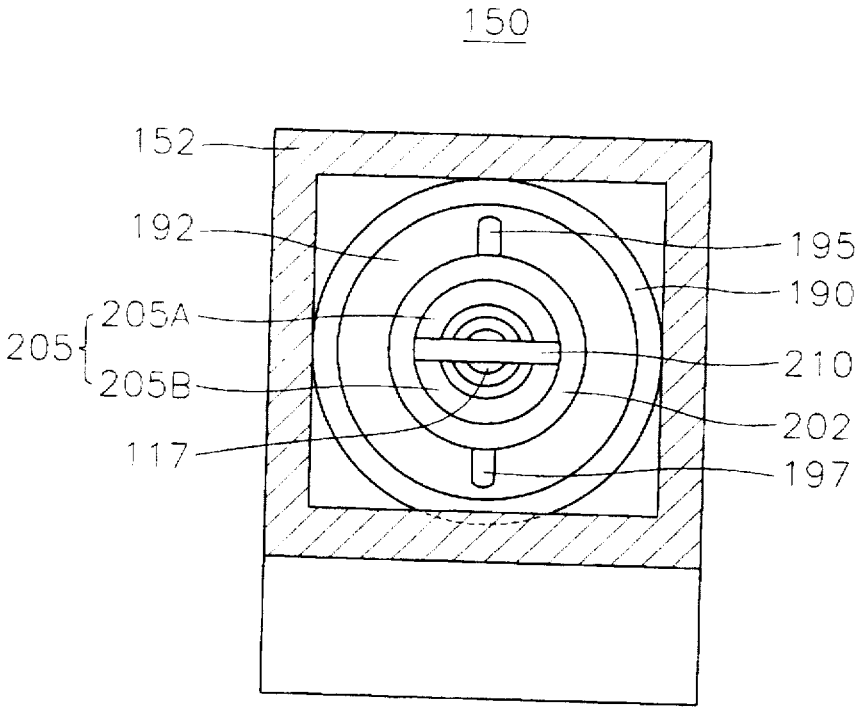
FIG. 2 is a sectional view taken along the line M-N shown in FIG. 1.

Referring to FIG. 2, first hollow-frustuconical member 190 is fixed to the inner wall of housing 152 by a fastening means such as welding. In addition, upper and lower support strips 195 and 197 are provided between an inner wall of first hollow-frustuconical member 190 and an outer wall of second hollow-frustuconical member 202 so as to support second hollow-frustuconical member 190. Upper and lower support strips 195 and 197 are made of a dielectric substance. First ends of upper and lower support strips 195 and 197 are welded to the inner wall of first hollow-frustuconical member 190, and second ends of upper and lower support strips 195 and 197 are welded to the outer wall of second hollow-frustuconical member 202.

Second wave guiding opening 205 of second hollow-frustuconical member 202 is divided into first and second semi-circular wave guiding openings 205A and 205B by transmission line 210 so that the high-frequency microwaves flowing into second wave guiding opening 205 are dispersed. Generally, transmission line 210 is made of a metal plate and reduces a transmission loss of the high-frequency microwaves.

Figure 3:
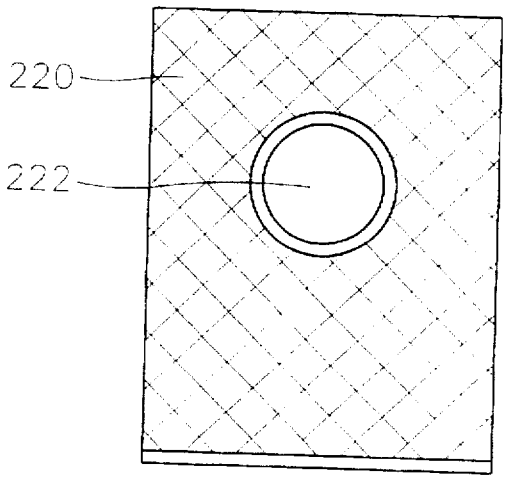
FIG. 3 is a front view of a differential mode absorber shown in FIG. 1.

Referring to FIG. 3, differential mode absorber 220 has a rectangular shape and is attached to the inner wall of housing 152 by a fastening means such as welding. Generally, differential mode absorber 220 is made of a porous glass wool so as to absorb distorted waves included in the high-frequency microwaves.

In addition, differential mode absorber 220 has a wave passage 222 for guiding the high-frequency microwaves into heating chamber 110. Wave passage 222 is concentrically formed with respect to first and second wave guiding openings 192 and 205. Wave passage 222 has a shape corresponding to first and second hollow-frustuconical members 190 and 202, so wave passage 222 is also inclined at an angle of about 35 degrees with respect to the central axis C thereof.

Generally, the distance L1 between mode transducer 200 and antenna 142 is set as follows: $L1=n\times\lambda/4$ (wherein, n=1, 3, 5 . . . , λ is a wave length). In this position, impedance is very sensitively varied. Accordingly, the power loss is reduced by installing mode transducer 200 to the above position.

For the same reason, the distance L2 between mode transducer 200 and differential mode absorber 220 is set as follows: $L2=n\times\lambda/4$ (wherein, n=1, 3, 5, . . . , λ is a wave length).

In addition, the high-frequency microwaves are more widely radiated as the distance between differential mode absorber 220 and partition 115 becomes longer. The distance can be adjusted by using the principle of coma aberration in such a manner that proper high-frequency microwaves can be radiated according to sorts of foods.

Microwave oven 100 having the above structure operates as follows.

Firstly, when a user turns on an operating switch(not shown) attached to a front portion of cabinet 130, a microcomputer(not shown) accommodated in microwave oven 100 sends an operating signal to transformer 160. As a result, transformer 160 generates the high-voltage and transfers the high-voltage to magnetron 140 so that the high-frequency microwaves are generated by magnetron 140. The high-frequency microwaves are transferred to a first area A in wave guide 150 through antenna 142.

Figure 4:
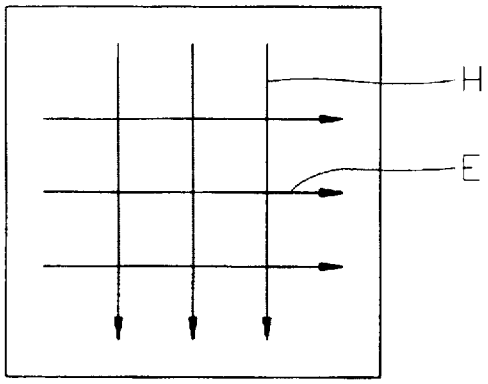
FIG. 4 is a view showing directions of an electric field and a magnetic field at the "A" area shown in FIG. 1.

As shown in FIG. 4, in a first area A, a magnetic field and an electric field of the high-frequency microwaves cross at right angles to each other.

Then, the high-frequency microwaves are dispersed into first and second wave guiding openings 192 and 205 formed in first and second hollow-frustuconical members 190 and 202, respectively.

While the high-frequency microwaves are passing through first and second wave guiding openings 192 and 205, the high-frequency microwaves are further dispersed by upper and lower support strips 195 and 197 and transmission line 210. At this time, upper and lower support strips 195 and 197 and transmission line 210 not only facilitate the transmission of the high-frequency microwaves, but also reduce the transmission loss of the high-frequency microwaves.

Figure 5:
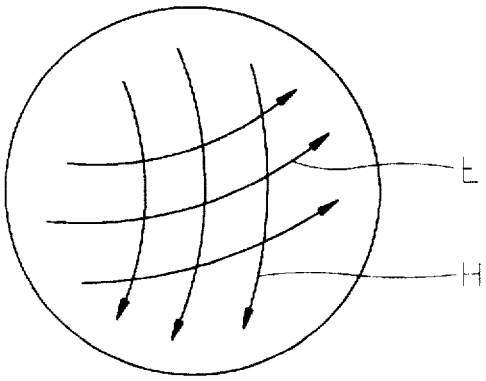
FIG. 5 is a view showing directions of an electric field and a magnetic field at the "B" area shown in FIG. 1.
Figure 6:
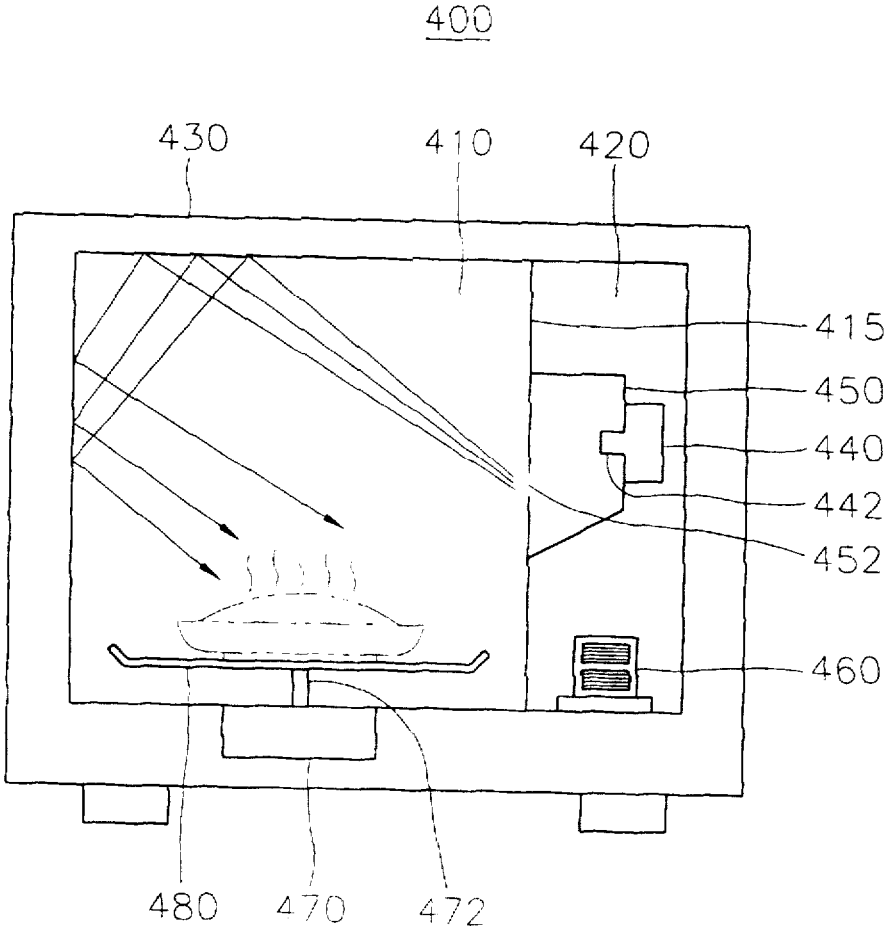
FIG. 6 (PRIOR ART)
FIG. 6 is a sectional view showing an internal structure of a conventional microwave oven.

When the high-frequency microwaves reach a second area B in wave guide 150, the magnetic field and the electric field of the high-frequency microwave are deflected against each other as shown in FIG. 5. This kind of deflection occurs due to geometrical variation of passages into which the high-frequency microwaves pass. In the second area B in wave guide 150, the high-frequency microwaves are superimposed over each other.

Then, the high-frequency microwaves pass through differential mode absorber 220. While passing through differential mode absorber 220, the distorted waves included in the high-frequency microwaves are absorbed by differential mode absorber 220.

Accordingly, superimposed and dispersed high-frequency microwaves are radiated into heating chamber 110 through aperture 117 formed in partition 115 so the food placed on cooking tray 180 is effectively heated. These kinds of high-frequency microwaves make the inside temperature of heating chamber 110 more uniform and improve the heating efficiency.

While the food is being heated, the microcomputer sends an operating signal to motor 170 so that cooking tray 180 rotates and thereby, the food placed on cooking tray 180 is more uniformly heated.

As described above, the microwave oven having the wave guide according to the present invention radiates the superimposed high-frequency microwaves into the heating chamber, so the food contained in the heating chamber is effectively heated and thereby, the cooking time is shortened.

Further, since the distorted waves included in high-frequency microwaves are removed by the differential mode absorber, the inside temperature of the heating chamber is more uniform and thereby, the food contained in the heating chamber is uniformly heated.

Furthermore, the microwave oven having the wave guide according to the present invention has a high heating efficiency, so a waste of electrical power can be prevented. In addition, it is possible to use a transformer having a relatively small electric capacity, so the manufacturing cost of the microwave oven is reduced.

Although the preferred embodiment of the invention has been described, it will be understood by those skilled in the art that the present invention should not be limited to the described preferred embodiment, but various changes and modifications can be made within the spirit and scope of the invention as defined by the appended claims.

What is claimed is:

1. A microwave oven comprising:

a heating chamber;

a control chamber;

a partition for separating the control chamber from the heating chamber;

a magnetron for generating a high-frequency microwave;

a housing disposed in the control chamber, the housing being attached to the partition and being provided at a side wall thereof with the magnetron;

a mode transducer for superimposing and distributing the high-frequency microwave radiated from the magnetron, the mode transducer being disposed in the housing, the mode transducer including a first hollow-frustuconical member having a first wave guiding opening, a second hollow-frustuconical member having a second wave guiding opening, and a transmission line attached to an inner wall of the second hollow-frustuconical member, the first hollow-frustuconical member being welded to an inner wall of the housing, the second hollow-frustuconical member being accommodated in the first hollow-frustuconical member; and a differential mode absorber for absorbing a distorted wave included in the high-frequency microwave which has been passed through the mode transducer, the mode transducer being disposed in the housing.

2. A microwave oven as claimed in claim 1, wherein the housing is welded to the partition, and the mode transducer and the differential mode absorber are welded to an inner wall of the housing.

3. A microwave oven as claimed in claim 1, wherein the transmission line is provided at a center of the second hollow-frustuconical member and is welded to an inner wall of the second hollow-frustuconical member, the transmission line extending to a position of the differential mode absorber.

4. A microwave oven as claimed in claim 1, wherein the first and second hollow-frustuconical members are coaxially disposed with each other, the first and second hollow-frustuconical members being inclined at an angle of about 35 degrees with respect to a central axis thereof.

5. A microwave oven as claimed in claim 1, wherein upper and lower support strips for supporting the second hollow-frustuconical member are provided between an inner wall of the first hollow-frustuconical member and an outer wall of the second hollow-frustuconical member.

6. A microwave oven as claimed in claim 5, wherein the upper and lower support strips are made of a dielectric substance, first ends of the upper and lower support strips being welded to the inner wall of the first hollow-frustuconical member, second ends of the upper and lower support strips being welded to the outer wall of second hollow-frustuconical member.

7. A microwave oven as claimed in claim 6, wherein the differential mode absorber has a rectangular shape and is formed at a center portion thereof with a wave passage.

8. A microwave oven as claimed in claim 7, wherein the differential mode absorber is made of a porous glass wool.

9. A microwave oven as claimed in claim 7, wherein the wave passage has a shape corresponding to the first and second hollow-frustuconical members, and is inclined at an angle of about 35 degrees with respect to a central axis thereof.

10. A microwave oven as claimed in claim 7, wherein the wave passage is concentrically formed with respect to the first and second wave guiding openings formed in the first and second hollow-frustuconical members, respectively.

* * * * *